US009849509B2

(12) United States Patent
Kohler et al.

(10) Patent No.: US 9,849,509 B2
(45) **Date of Patent: *Dec. 26, 2017**

(54) LADLE BOTTOM AND LADLE

(71) Applicant: REFRACTORY INTELLECTUAL PROPERTY GMBH & CO. KG, Vienna (AT)

(72) Inventors: Sarah Kohler, Leoben (AT); Alexander Maranitsch, Vienna (AT); Bernhard Spiess, Vienna (AT)

(73) Assignee: REFRACTORY INTELLECTUAL PROPERTY GMBH & CO. KG, Wien (AT)

( * ) Notice: Subject to any disclaimer, the term of this patent is extended or adjusted under 35 U.S.C. 154(b) by 116 days.

This patent is subject to a terminal disclaimer.

(21) Appl. No.: 14/899,660

(22) PCT Filed: Jun. 26, 2014

(86) PCT No.: PCT/EP2014/063565

§ 371 (c)(1),
(2) Date: Dec. 18, 2015

(87) PCT Pub. No.: WO2015/036134

PCT Pub. Date: Mar. 19, 2015

(65) Prior Publication Data

US 2016/0167126 A1 Jun. 16, 2016

(30) Foreign Application Priority Data

Sep. 10, 2013 (EP) ..... 13183674

(51) Int. Cl.
*B22D 41/08* (2006.01)

(52) U.S. Cl.
CPC ..... *B22D 41/08* (2013.01)

(58) Field of Classification Search
CPC .... B22F 2999/00; B22F 9/24; B22F 2202/11; B22F 1/0018; B22F 1/0062; B22F 1/02; B22F 9/16; B01J 19/0093; B01J 2219/00795; B01J 2219/0086; B01J 2219/00869; B01J 2219/00873; B01J 2219/00882; B01J 2219/00889; B01J 2219/009; B01J 2219/00934; B01J 2219/00941; B01J 2219/00957;
(Continued)

(56) References Cited

U.S. PATENT DOCUMENTS 4,746,102 A * 5/1988 Gilles ..... B22D 41/08 266/236
4,776,570 A * 10/1988 Vo Thanh ..... B22D 41/003 266/229

(Continued)

FOREIGN PATENT DOCUMENTS

GB 2094954 A 9/1982

OTHER PUBLICATIONS

International Search Report for App. No. PCT/EP2014/063585 dated Sep. 9, 2014.

*Primary Examiner* — Scott Kastler
*Assistant Examiner* — Michael Aboagye
(74) *Attorney, Agent, or Firm* — Medley, Behrens & Lewis, LLC

(57) ABSTRACT

A ladle bottom being part of a metallurgical ladle for treating a metal melt as well as a corresponding metallurgical ladle.

12 Claims, 4 Drawing Sheets

Figure 1:
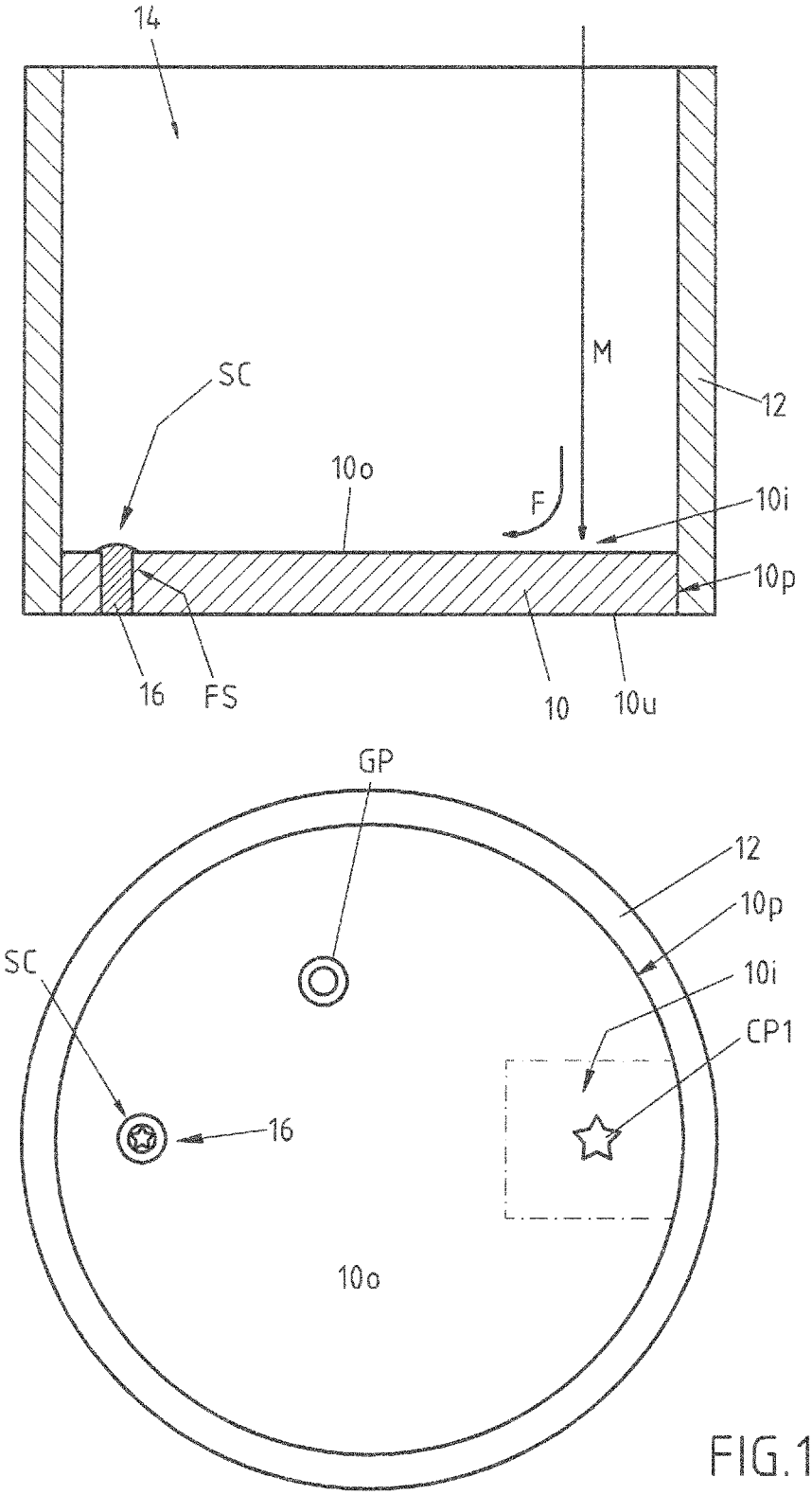
FIG.1 (prior art)

(58) Field of Classification Search
CPC ..... B01J 2219/0097; B22D 41/08; C01B 19/002; C01G 21/21; C01P 2004/03; C21C 7/0075; F27B 14/08; F27D 1/0006; F27D 1/0043; F27D 3/1518; F27D 3/1536
USPC ..... 266/236, 275; 222/590, 591, 594; 164/337, 437, 488, 335
See application file for complete search history.

(56) References Cited

U.S. PATENT DOCUMENTS 5,188,796 A * 2/1993 Soofi ..... B22D 41/003 222/594
5,348,275 A * 9/1994 Soofi ..... B22D 41/50 222/591
5,518,153 A * 5/1996 Zacharias ..... B22D 41/003 222/594
2016/0031008 A1 * 2/2016 Kohler ..... B22D 41/08 222/591

* cited by examiner

LADLE BOTTOM AND LADLE

The invention relates to a ladle bottom being part of a metallurgical ladle for treating a metal melt as well as a corresponding metallurgical ladle.

Such a ladle bottom is made of a refractory ceramic body providing an upper surface, a lower surface and a pouring channel extending between upper surface and lower surface. As part of the ladle the ladle bottom is fitted within one end of a corresponding wall portion, wherein the wall extends from the outer periphery of the ladle bottom.

Ladle and ladle bottom each are described hereinafter in a position when the ladle bottom is arranged horizontally and at the lower end of the ladle.

A metal melt is poured (cast) into the ladle via an open upper end of the ladle. The metal stream first hits the ladle bottom, before being redirected to flow along the upper surface of the ladle bottom and towards the pouring channel (outlet nozzle), which is in many applications closed at this stage of the casting process by a filler sand to avoid uncontrolled outflow of the metal melt. During this stage of the casting process several problems arise, inter alia:

- A considerable wear of refractory material along the impact area when the metal stream hits the refractory material.
- The filler sand, in particular any filler material protruding the upper surface of the ladle bottom, is flushed away in an uncontrollable manner by the melt stream, thus causing irregularities and/or defects in the following casting sequence.

To solve the wear problem numerous proposals have been made. To reduce such wear it is known to use refractory materials for said impact area which are less prone to wear and/or to provide a discrete, so-called impact pad which is arranged on top of the upper bottom surface.

The filler sand problem hasn't been solved yet.

The filler material further causes problems during gas treatment of the melt in the ladle. Typically such treatment gas is fed into the metal melt via so called gas purging plugs (German: Gasspülsteine), arranged in the bottom and/or wall portion of the ladle, causing turbulences within the melt volume. Filler sand again is accidentally flushed away by these turbulences before tapping starts.

This is true in particular during so-called "hard stirring", being defined by a gas volume of >40 $m^3/h$ (typically 40-70 $m^3/h$) for an industrial ladle comprising 100.000 to 300.000 kg metal melt. "Soft stirring" describes a gas treatment with gas volumes below said 40 $m^3/h$, in particular volumes of 10-30 $m^3/h$.

The problems caused by gas flushing haven't been solved either yet.

Another concern is to reduce the amount of any metal remaining in the ladle after tapping (metal melt outflow into successive installations). Typically a considerable amount of metal melt remains onto the ladle bottom, solidifies and must be treated before refilling the ladle.

The invention therefore has the object to provide a technical solution to improve one or more of the following issues:

- To reduce or avoid uncontrolled sweeping off (flushing away) of such filler sand being arranged along and often on top of the pouring channel, which extends from the upper surface of the ladle bottom towards its lower surface and corresponding installations like nozzles/sliding plates etc.
- To reduce the volume of any metal melt remaining in the ladle after the ladle was emptied.

During intensive investigations, including water modelings and mathematical studies it has been found that various factors are responsible for the drawbacks mentioned, inter alia:

- The overall mass of the melt and the melt speed. In a typical metallurgical ladle comprising 150.000 to 250.000 kg steel melt the filling time is only about 4-6 minutes.
- The most severe conditions are at the beginning of the casting process and during gas treatment of the melt in the ladle.
- The overall size of the ladle bottom and the distance between impact area and pouring channel.
- The way and direction of the melt on its way from the impact area to the pouring channel.

Considering these and other factors it was found that the drawbacks mentioned may be at least reduced by using a ladle bottom comprising the following features:

- it is made of a refractory ceramic body with an upper surface, a lower surface and a pouring channel extending between upper surface and lower surface,
- it comprises a diffusor box, being defined by a deepened section of said upper surface, wherein the said diffusor box is characterized by the following features:
- it is arranged at a distance to a surface area of the ladle bottom used as an impact area for a metal melt poured onto said ladle bottom, in particular if

- it is arranged at a distance to each gas purging element within the ladle bottom and/or
- it has a step at least along its border facing the impact area, wherein said step has a vertical height of between 40 and 200 mm and/or
- it has a minimum horizontal area $$A_{min} = \frac{n}{4}(0.37\ r)^2 + 0.3$$

and a maximum horizontal area $$A_{max} = \frac{n}{4}(0.8\ r)^2 + 0.3$$

wherein r=radius of the ladle bottom and r≥0.75 m with $r_{max}$=2 m for all ladle bottoms with an effective radius of ≥2 m, and Π=pi=3.14 (hereinafter called formulae I), and/or

- an inlet end of said pouring channel is arranged offset the step along its border facing the impact area.

The main feature is the so-called diffusor box. The term "diffusor box" implements its main task, namely to slow down the speed of the metal melt on its way off the ladle.

Considerable improvements are possible if this diffusor box is varied in such a way that it comprises a further indentation (deepened section in the diffusor box bottom). This gradation (smaller diffusor box following a larger diffusor box in the outflow direction of the metal melt) may be repeated one or more times, e.g. the indentation again may be followed by a recessed space extending from part of the bottom area or the indentation, etc.

In other words: In addition to the (main) diffusor box (of arbitrary size) as mentioned above these embodiments are characterized by one or more additional diffusor boxes, arranged as follows (seen in the flow direction of the melt on its way from the ladle through the pouring channel into subsequent installations):

- a subsequent diffusor box extends from the bottom (its upper surface) of the precedent diffusor box
- a subsequent (downstream) diffusor box is of smaller horizontal cross section than the precedent one, meaning that any subsequent diffusor box extends from only part of the bottom (upper surface) of the precedent one. The horizontal size of any subsequent deepened section can be 10-90% or 15-85% or 20-80% of the previous one. The horizontal size of the lowermost deepened section (from where the lower section of the pouring channel starts) can be 10-50%, for example 10-32% of the main diffusor box.

It was witnessed that the predominant part of melt remaining in the ladle follows the successively arranged deepened sections around the outlet channel. This leads unambiguously to a considerable reduction of the metal melt volume remaining in the ladle after tapping/emptying (deutsch: Pfannenabstich).

The invention therefore relates—in its most general embodiment—to a ladle bottom made of a refractory ceramic body with an upper surface, a lower surface and a pouring channel extending between upper surface and lower surface, further comprising a diffusor box, being defined by a deepened section of said upper surface, wherein the said diffusor box is characterized by the following features:

- it is arranged at a horizontal distance to a surface area of the ladle bottom used as an impact area or a metal melt poured onto said ladle bottom,
- it defines a secondary upper surface of the ladle bottom, vertically below the upper surface,
- an indentation, extending from said secondary upper surface towards the lower surface of the ladle bottom and defining a tertiary upper surface of the ladle bottom, vertically below the secondary upper surface, wherein
- the pouring channel runs through said diffusor box and indentation.

The pouring channel defines an outlet channel for the metal melt, i. e. a passageway along which the melt leaves the ladle. In view of the at least two subsequent diffusor boxes of different size the upper section of the pouring channel is defined by the said diffusor boxes (main diffusor box and indentation) and thus characterized by an upper end of large cross section (the horizontal extension of the diffusor box), an intermediate part of medium sized cross section (the indentation) and a lower end of small cross section. In other words: The pouring channel according to the invention is characterized by a stepped upper part and a conventional lower part of substantially constant cross section.

As mentioned above this design may be completed by adding one or more further deepened sections within the bottom layout. Accordingly the ladle bottom—inter alia—may further comprise

- a recessed space, extending from said tertiary upper surface towards the lower surface of the ladle bottom and defining a quaternary upper surface of the ladle bottom, vertically below the tertiary upper surface, wherein
- the pouring channel now penetrates the recessed space as well.

"Secondary, tertiary, quaternary upper surfaces" define the bottom area of the successive deepened sections of said outflow area.

Embodiments with one, two and three deepened sections are represented and further disclosed in the attached drawing and corresponding description.

This general concept of stepped depressions, wherein the vertically lower (downstream) depression always being of smaller (horizontal) size than the depression arranged vertically on top (upstream), may be varied/completed by numerous features, inter alia:

- At least one of the following surfaces of the ladle bottom may be inclined to the horizontal: upper surface, secondary upper surface, tertiary upper surface, quaternary upper surface. The angle of inclination may be relatively low, with a lower value of 1° and an upper value of 10° and preferred ranges between 2 and 6°. The direction and degree of inclination may vary between vertically adjacent/subsequent upper surfaces. One or more horizontally oriented upper surfaces may remain.
- At least one of the following surfaces of the ladle bottom may have a three dimensional profile: upper surface, secondary upper surface, tertiary upper surface, quaternary upper surface.
- The profile can be at least one of the group comprising: ribs, knobs, prism, depression, channel. Any male or female profiles may extend towards the lower vertically oriented section of the pouring channel, radially to the pouring channel, parallel to one or more tangents of the lower part of the pouring channel or parallel to the outer periphery of the lower part of the pouring channel, or combinations thereof. Male profiles should not protrude the corresponding vertical height of the corresponding diffusor box, indentation and/or recessed space respectively, but may be limited to ⅔ thereof.
- At least one of the following surfaces of the ladle bottom can have a polygonal, circular or oval shape: secondary upper surface, tertiary upper surface, quaternary upper surface. Regarding a rectangular shape the relation between length/width may be—for example—>1.5 or >2.0 or >2.5 or >3.0. The same relations apply with oval shapes wherein length and width are defined by the longest and shortest distance between opposing sections.
- Subsequent upper surfaces of the ladle bottom can be dimensioned such that any downstream surface has an overall area being <80%, <60% or even <40% of the upper surface arranged upstream (on top).
- Subsequent upper surfaces of the ladle bottom are dimensioned such that they are vertically offset, thereby forming a step (S) at least about part of their respective peripheries. This gives a step like profile along the outer walls of the bottom cavities along which the melt flows.
- The invention provides one or more steps along that way the metal stream takes after hitting the impact area and before entering the lower section of the pouring channel.
- The term "step" is defined as a geometrical discontinuity. Two right angles with the adjacent upper surface sections describe the ideal step, although slight variations (<+/−30 degrees, better <+/−20 degrees, even better <+/−10 degrees) may be accepted under technical conditions. At least part of each step may also be curved or sloped.
- This step reduces the melt speed significantly. The (vertical) height of the steps is preferably set between 20 and 200 mm, wherein the upper limit may be set as well at 160 mm, 150 mm, 140 mm, 125 mm or even at 100 mm, while the minimum height may be set as well at 45 mm, 50 mm, 55 mm or 60 mm. A height of less than 20 mm does not influence the speed of the metal melt sufficiently to protect the filler sand in the pouring channel. A height of more than 200 mm contradicts the effect because of excessive splashing.

This step may extend along at least part of the periphery of the lower (downstream) surface, for example along at least 50% or >70%, >80%, >90%.

According to one embodiment the secondary upper surface (overall bottom area of diffusor box) has a minimum horizontal area according to formulae I. These dimensions have been proved valuable.

Good result were achieved with a diffusor box describing a horizontal area which corresponds to 3.7 to 32.9% of the total upper surface area of the ladle bottom. The minimum value may be set as well at 5.8% while the upper value may be equal or smaller than 25.5% of the total surface area of the ladle bottom.

It has been proved valuable to arrange the deepened sections (diffusor box, indentation, recessed space) offset the impact area of the ladle and offset any gas purging elements; in other words: in proximity to the ladle wall, wherein the ladle wall may border one or more of said deepened sections partially.

Any downstream arranged deepened section (indentation, recessed space etc) should provide two common wall sections with any upstream deepened section (indentation, diffusor box) at the most.

The provision and design of the diffusor box, indentation and/or recessed space as well as any further depressions is important to reduce the kinetic energy of the metal melt before the melt reaches the inlet end of the lower section of the pouring channel and thus before the melt gets in contact with any filler material (filler sand) within and/or on top of the pouring channel. It is as well important to reduce turbulences of the melt within the ladle during gas purging treatment.

The (upper) diffusor box is arranged at a distance to the impact area to reduce the effect of splashing around the impact area and to provide a sufficient distance between impact area and pouring channel.

According to one embodiment the distance between a central point along the upper surface of the impact area and a central point along the upper surface of the diffusor box is about 30 to 75% of the maximum horizontal extension of the ladle bottom, with possible lower limits at 40, 45 or 50% and possible upper limits at 65 and 70%. With the minimum diameter of the ladle bottom being defined at 1.5 m good results are achieved with distances of 500 to 1200 mm. With the maximum diameter considered in the disclosed formulae being set at 4 m, even in cases of a ladle bottom with an effective diameter of >4 m, good results are achieved with distances of >1500 mm for large ladle bottoms.

The "central point" of the impact area may be defined as that point which the central longitudinal axis of the metal stream flowing into the ladle hits. The central point of the diffusor box is the geometrical centre, which may fall into the area defined by the lower end of the pouring channel (in corresponding vertical extension).

The disclosed overall size (in $m^2$) of the diffusor box may be set according to formulae I, especially in cases with no further deepened sections. In designs with one or more (n) further deepened sections the size of the topmost diffuser box is less critical. The upper and lower limits recognize the influence of gas purging during a secondary metallurgical treatment of a melt in the ladle. These limits are valuable for the reduction of turbulences in the space defined by the diffusor box and especially next to its surface.

Typically the speed of the metal melt next to the upper surface of the ladle bottom is up to 0.3 m/s. High speeds are due to "hard stirring", lower values may prevail during "soft stirring". Insofar $A_{max}$ is mainly influenced by "soft stirring" while $A_{min}$ defines the preferred size in case of "hard stirring".

In other words: The melt is typically gas treated in the ladle by "soft stirring" and "hard stirring" intervals. Insofar the overall size of the diffusor box is defined by both.

In cases when "hard stirring" dominates the overall size of the surface area of the diffusor box can be $<(A_{min}+A_{max})/2$, best as close as possible to $A_{min}$ while it can be $>(A_{min}+A_{max})/2$ in case of "soft stirring" prevails and then as close as possible to $A_{max}$. A surface area of exactly $(A_{min}+A_{max})/2$ is a compromise between the two alternatives. Similar results may be achieved with an overall surface area of the diffusor box in the range of +/−10% or +/−20% of $(A_{min}+A_{max})/2$.

In case of "hard stirring" it is further preferred to provide a diffusor box with a height of the step at the upper end of the disclosed range, especially >80 mm or >100 mm.

In all embodiments filler sand is flushed off much less during gas purging compared with conventional designs of ladle bottoms as mentioned above.

To reduce accidental wear of filler material It is further advantageous to keep a minimum distance between any gas purging element and the pouring channel. Preferably there are no gas flushing/purging elements in the diffusor box area and the minimum distance is defined correspondingly to the minimum distance between impact spot and pouring channel.

The following table quotes useful upper and lower values of the so-called secondary upper surface of the diffusor box [in $m^2$]:

| example | ladle bottom diameter in m | $A_{min}$ in $m^2$ | $A_{max}$ in $m^2$ |
|---|---|---|---|
| A | 1.5 | 0.361 | 0.583 |
| B | 2.5 | 0.468 | 1.085 |
| C | 3.5 | 0.629 | 1.839 |

It may vary depending on the number (1 . . . n) of subsequent deepened sections like the said indentation and recessed space.

The absolute upper value ($A_{max}$) may be set at 2.3 $m^2$, 2.2 $m^2$, 2.1 $m^2$ or 2.0 $m^2$. The overall size ($A_{min}$) of the diffusor box is important as well to allow the metal melt to distribute over the diffusor area and thus to further slow down. $A_{max}$ is important to allow a sufficient (minimum) distance between impact area (and/or gas purging element) and pouring channel. The same is true with respect to any further deepened sections following the diffusor box in a downstream direction.

Finally the position of the successive deepened spaces and the lower section of the pouring channel influence the required effect. It is recommended to arrange the vertical axis of the lower section of the pouring channel offset to any steps and offset the ladle wall.

In case of a pouring channel with a diameter of X mm (for example: 40 mm) the minimum distance between the lower part of the pouring channel and any corresponding step should be 3X (for example 120 mm) but may reach 7X or more.

The invention includes a ladle comprising a bottom as mentioned above. Both (ladle and ladle bottom) are shown in the attached drawing.

The invention further provides an embodiment characterized by a dam like protrusion between impact area and diffusor box in order to further reduce the melt speed flowing along the bottom area from said impact area toward said diffusor box. This protrusion extends substantially perpendicular to a direction along which the corresponding metal melt will flow from the impact area into the diffusor box after hitting the impact area. In other words: The melt is temporarily stopped in front of the protrusion (barrier) and may only continue its flow after having passed the said obstacle.

Further features of the invention may be derived from the sub-claims and the other application documents The size of the diffusor box may be defined alternatively or as an additional condition to the formulae I by the following formulae II: The thus preferred area of the diffusor box is characterized by the intersection of formulae I and formulae II respectively.

$$A_{min}=x+10/161\cdot \ln [M]$$

$$A_{max}=5y+4/25\cdot \ln [M]$$

with x=0.16 to 0.20 and y=0.20 to 0.16

M=nominal mass of the metal melt in the associated ladle (in 1000 kg) and $A_{min}$ as well as $A_{max}$ in square meters ($m^2$), with possible limited ranges:

x=0.16 to 0.17 and y=0.20 to 0.19 x=0.16 to 0.18 and y=0.20 to 0.18.

The attached drawing schematically represents in

FIG. 1 a prior art ladle in a longitudinal sectional view and a top view

Figure 2:
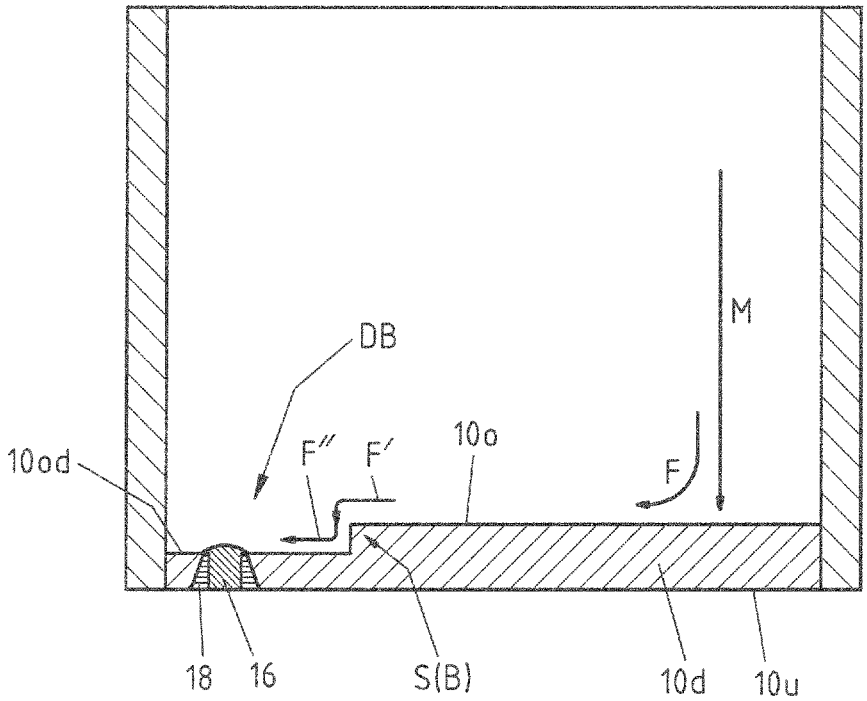
Figure 2:
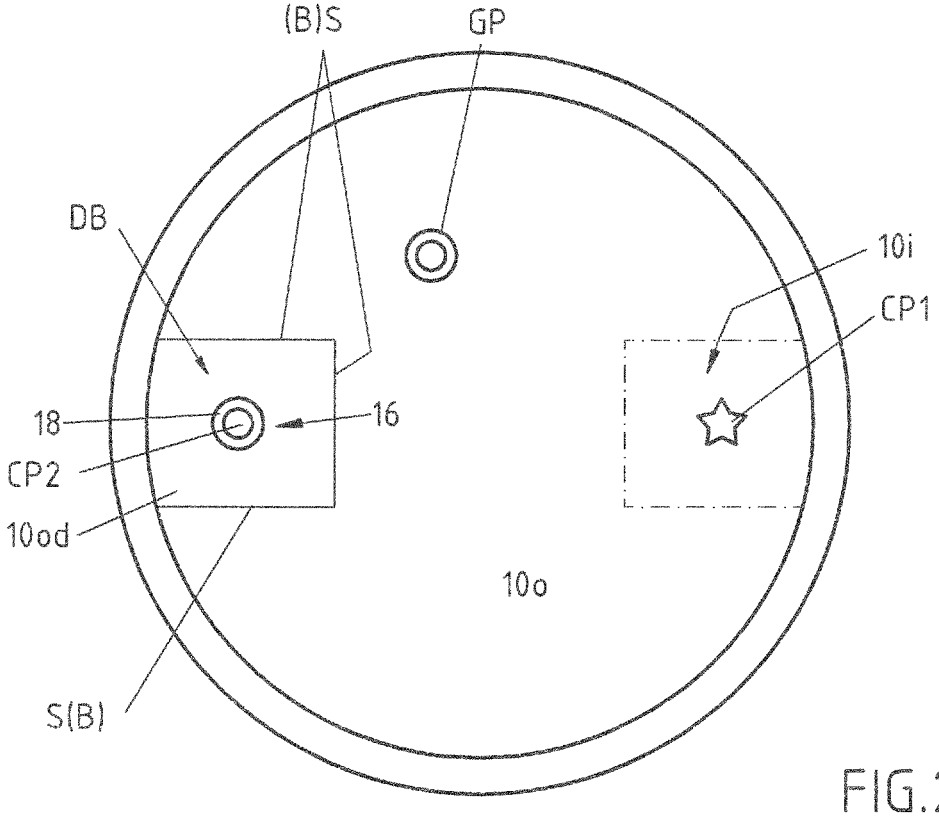
Figure 3:
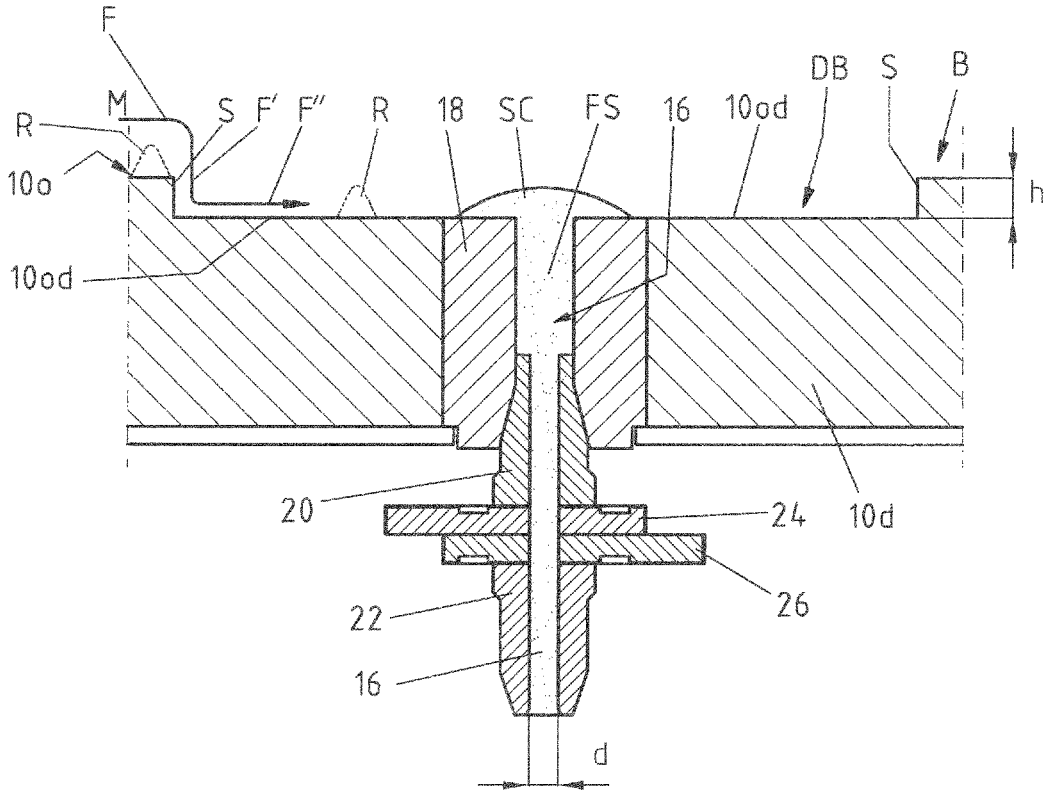
Figure 5:
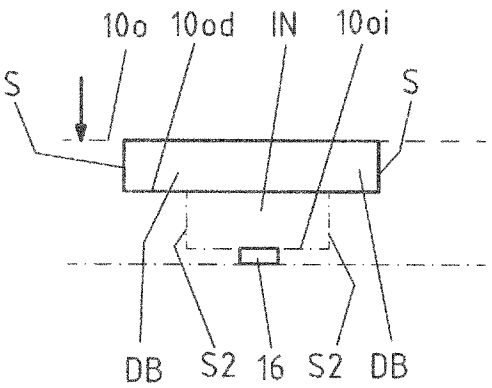
Figure 4:
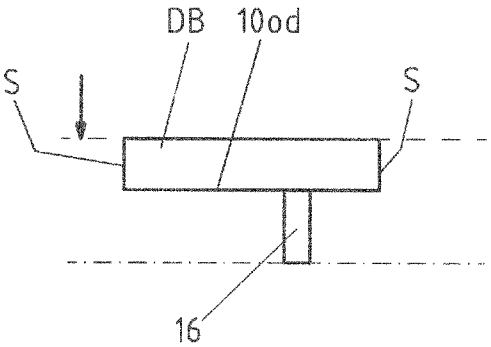

FIG. 2 a ladle with one single diffusor box in a longitudinal sectional view and a top view FIG. 3 an enlarged longitudinal section of a slightly different shape of a diffusor box with adjacent components FIG. 4 the embodiment of FIG. 3 in a still more schematic cross sectional view FIG. 5 a further embodiment with one additional indentation in a view according to FIG. 4

Figure 6:
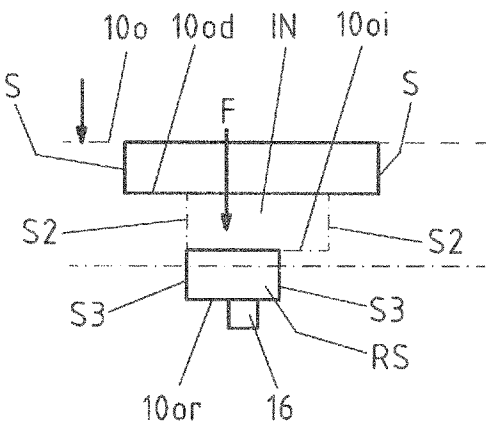

FIG. 6 a third embodiment with one additional indentation and one additional recessed space in a view according to FIG. 4

The same numerals are used for parts providing the same or at least similar features.

The ladle of FIG. 1 has a circular, horizontally extending bottom 10 with an upper horizontal surface 10*o* and a lower horizontal surface 10*u*. A substantially cylindrical ladle wall 12 extends upwardly from the outer periphery 10*p* of ladle bottom 10. An open upper end of the ladle is symbolized by numeral 14.

A metal stream is shown by arrow M, entering the ladle by its open end 14, flowing vertically downwardly before hitting an impact area 10*i* of the upper surface 10*o* of ladle bottom 10.

At least part of the metal stream continues its flow (arrow F) towards a pouring channel 16 arranged offset to said impact area 10*i*, which pouring channel 16 runs from upper surface 10*o* to lower surface 10*u*.

As shown in FIG. 1 the said pouring channel 16 is filled with a so called filling sand FS and a sand cone SC may be seen on top of channel 16. The filler material keeps the metal melt off the channel during filling the ladle. It serves to avoid unintended tapping when the ladle is filled. Insofar it has an important function within the casting process.

In a prior ladle according to FIG. 1 the sand SC may be flushed away by the melt stream (arrow F), causing serious uncertainties and risks in the following casting process. This filler material is further at least partially flushed away in case of a gas treatment of the melt by gas purging plugs, one of which is shown and represented by GP.

The ladle design according to FIG. 2,3 provides a diffusor box DB around the upper part of said pouring channel 16 and offset (at a distance to) said impact area 10*i*.

The diffusor box DB is characterized by a recess within upper surface 10*o*, i.e. a section deepened with respect to the adjacent areas of upper surface 10*o* and thus providing a step S along the border (borderline, periphery) B of said diffusor box DB. The upper surface section of diffusor box DB is referred to hereinafter as secondary upper surface 10*od*. The vertical part of said step S forms a right angle with respect to both adjacent sections of the upper bottom surface 10*o* and secondary upper surface 10*od*.

The diffusor box DB has a mainly rectangular secondary upper surface 10*od*. A well nozzle 18 (German: Lochstein) is arranged in the bottom portion 10*d* of the diffusor box DB. The central through opening of said well nozzle 18 defines a lower part of pouring channel 16, while the diffusor box DB itself defines the widened upper part of pouring channel 16.

An inner nozzle 20—known per se—is arranged downstream within the lower part of said well nozzle 18, followed in a conventional way by a sliding gate with sliding plates 24, 26 and an outer nozzle 22.

The lower part of the pouring channel 16 is filled with filler sand FS, including a sand cone SC on top of well nozzle 18—similar to FIG. 1—.

The dimensions of said diffusor box DB are as follows:

height h of step S: 100 mm length: 1370 mm, width: 1085 mm diameter d of pouring channel 16 along nozzles 20,22: 80 mm distance between a central point CP1 of the impact area 10*i* (along the upper surface 10*o*) and a central point CP2 along the secondary upper surface of the diffusor box DB: 2200 mm.

inner diameter of the ladle bottom 10: 3530 mm

The melt stream M hits the impact area 10*i* (with CP1 being the central hitting point) in a conventional way but its speed is then slowed down on its way to the lower section of pouring channel 16 by said diffusor box DB and especially by said step S, which at the same time redirects the melt stream M twice (FIG. 3: F, F', F").

By this means the filler material FS is protected from being flushed away until the ladle is filled more or less completely and the pouring channel 16 opened in a conventional way.

The filler material remains more or less intact and at its place, even in case of a (conventional) gas treatment of the melt as the then rotating melt "overflows" said area of said diffusor box to a considerable extent with a considerably reduced speed. One of several gas purging plugs, installed in ladle bottom 10 is shown as GP. The distance between its central longitudinal axis and CP2 is 1020 mm.

FIG. 3 shows a diffusor box DB arranged offset ladle wall 12, i.e. with a circumferentially extending borderline/periphery B and step S. It further includes an optional feature of a barrier shaped as a rib R in front of said step S and/or in front of the pouring channel 16 (seen in the flow direction F of the metal melt MS) to further reduce the melt speed. Insofar the said barrier is arranged perpendicular to a straight line between CP 1 and CP 2 being the main direction of the melt on its way from impact area 10*i* to the lower part of the pouring channel 16, symbolized by arrows F, F', F". This barrier may be replaced by one or more protruding shapes, including: undulated surface sections, dams, prism or the like.

FIG. 4 represents the embodiment of FIG. 3 in a more schematic way to improve illustration and comparison with the embodiments of FIGS. 5,6.

The ladle bottom 10 of FIG. 5 differs from that of FIG. 4 by the following features:

Secondary upper surface 10*od* (the bottom surface of diffusor box DB) includes a further deepened section, called indentation IN hereinafter.

This indentation IN has a smaller horizontal cross section than diffusor box DB and extends at a distance to the peripheral steps S of diffusor box DB, thereby providing additional steps S2 and a tertiary upper surface 10*oi*.

The lower section of pouring channel 16 now extends from said tertiary upper surface 10*oi* downwardly.

In the embodiment of FIG. 6 the indentation IN is followed (in a downstream direction of metal flow F) by a recessed space RS, thereby providing a quaternary upper surface 10*or*, further steps S3 on 3 sides (the $4^{th}$ being flush with adjacent step S2), and a horizontal cross section smaller than that of indentation IN. While the upper section of pouring channel 16 being defined by the hollow spaces of diffusor box DB, indentation IN and recessed space RS its lower part now extends from recessed space RS downwardly.

In this embodiment tertiary upper surface 10*oi* is inclined by 4° to the horizontal.

All embodiments are characterized by several deviations for the metal stream on its way to the lower part of pouring channel 16, provided by said deepened sections (diffusor box DB, indentation IN, recessed space RD respectively) and their corresponding steps S, S2,S3, thereby slowing down the melt speed and allowing any remaining melt to leave the ladle almost completely.

The invention claimed is:

1. Ladle bottom made of a refractory ceramic body with an upper surface, a lower surface and a pouring channel extending between the upper surface and the lower surface, further comprising a diffusor box, being defined by a deepened section of said upper surface, wherein the diffusor box is characterized by the following features:

a) it is arranged at a horizontal distance to a surface area of the ladle bottom used as an impact area for a metal melt poured onto said ladle bottom, b) it defines a secondary upper surface of the ladle bottom, vertically below the upper surface, c) wherein the secondary upper surface has a minimum horizontal area $$A_{min} = \frac{n}{4}(0.37\ r)^2 + 0.3$$

and a maximum horizontal area $$A_{max} = \frac{n}{4}(0.8\ r)^2 + 0.3$$

wherein r=radius of the ladle bottom and r≥0.75 m with $r_{max}$=2 m for all ladle bottoms with an effective radius of ≥2 m, d) an indentation, extending from said secondary upper surface towards the lower surface of the ladle bottom and defining a tertiary upper surface of the ladle bottom, vertically below the secondary upper surface, wherein e) the pouring channel runs through said diffusor box and indentation.

2. Ladle bottom according to claim 1, further comprising a) a recessed space, extending from said tertiary upper surface towards the lower surface of the ladle bottom and defining a quaternary upper surface of the ladle bottom, vertically below the tertiary upper surface, wherein b) the pouring channel runs as well through said recessed space.

3. Ladle bottom according to claim 1, wherein at least one of the following surfaces of the ladle bottom is inclined to the horizontal: upper surface, secondary upper surface, tertiary upper surface.

4. Ladle bottom according to claim 1, wherein at least one of the following surfaces of the ladle bottom has a three dimensional profile: upper surface, secondary upper surface, tertiary upper surface.

5. Ladle bottom according to claim 4, wherein the profile is at least one of the group comprising: ribs, knobs, prism, depression, channel.

6. Ladle bottom according to claim 1, wherein at least one of the following surfaces of the ladle bottom has a polygonal, circular or oval shape: secondary upper surface, tertiary upper surface.

7. Ladle bottom according to claim 1, wherein adjacent upper surfaces of the ladle bottom are dimensioned such that the upper surface being closer to the lower surface of the ladle bottom, has an overall area being <60% of the surface arranged on top.

8. Ladle bottom according to claim 1, wherein adjacent upper surfaces of the ladle bottom are vertically offset by 20 to 200 mm, thereby forming a step at least about part of their respective peripheries.

9. Ladle bottom according to claim 8, wherein the step extends along at least 50% of the periphery of the lower of said upper surfaces.

10. Ladle bottom according to claim 1, with a distance between a central point along the upper surface of the impact area and a central point along the upper surface of the diffusor boxbeing 30 to 75% of the maximum horizontal extension of the ladle bottom.

11. Ladle bottom according to claim 1, with a distance between a central longitudinal axis of a gas purging plug arranged in the ladle bottom and a central point along the upper surface of the diffusor box being 30 to 75% of the maximum horizontal extension of the ladle bottom.

12. Metallurgical ladle with a ladle bottom, the ladle bottom made of a refractory ceramic body with an upper surface, a lower surface and a pouring channel extending between the upper surface and the lower surface, further comprising a diffusor box, being defined by a deepened section of said upper surface, wherein the diffusor box is characterized by the following features:

a) it is arranged at a horizontal distance to a surface area of the ladle bottom used as an impact area for a metal melt poured onto said ladle bottom, b) it defines a secondary upper surface of the ladle bottom, vertically below the upper surface, c) wherein the secondary upper surface has a minimum horizontal area $$A_{min} = \frac{\pi}{4}(0.37\ r)^2 + 0.3$$

and a maximum horizontal area $$A_{max} = \frac{\pi}{4}(0.8\ r)^2 + 0.3$$

wherein r=radius of the ladle bottom and r≥0.75 m with $r_{max}$=2 m for all ladle bottoms with an effective radius of ≥2 m, d) an indentation, extending from said secondary upper surface towards the lower surface of the ladle bottom and defining a tertiary upper surface of the ladle bottom, vertically below the secondary upper surface, wherein e) the pouring channel runs through said diffusor box and indentation.

* * * * *